United States Patent [19]

Schneider et al.

[11] Patent Number: 5,075,937

[45] Date of Patent: Dec. 31, 1991

[54] BUCKLE FOR A SAFETY BELT

[75] Inventors: Wolfgang Schneider; Martin Specht, both of Munich; Rudolf Meyer, Odelzhausen, all of Fed. Rep. of Germany

[73] Assignee: BSRD Limited, Carlisle, United Kingdom

[21] Appl. No.: 241,656

[22] Filed: Sep. 8, 1988

[30] Foreign Application Priority Data

Sep. 18, 1987 [DE] Fed. Rep. of Germany ..... 3731521

[51] Int. Cl.[5] ..... A44B 11/25

[52] U.S. Cl. ..... 24/637; 24/641

[58] Field of Search ..... 24/637, 633, 636, 640, 24/641; 280/801; 297/468, 483

[56] References Cited

U.S. PATENT DOCUMENTS

| | | | |
|---|---|---|---|
| 4,358,877 | 11/1982 | Burke | 24/641 |
| 4,391,024 | 7/1983 | Morinaga | 24/637 |
| 4,527,317 | 7/1985 | Straszewski et al. | 24/637 X |
| 4,575,907 | 3/1986 | Takada | 24/637 X |
| 4,677,715 | 7/1987 | Escaravage | 24/637 |
| 4,677,716 | 7/1987 | Monsigny | 24/641 |
| 4,802,266 | 2/1989 | Doty et al. | 24/637 |

*Primary Examiner*—Laurie K. Cranmer

[57] ABSTRACT

A buckle for a safety belt of a vehicle, especially a motor vehicle, the locking member of which is designed as a cylindrical revolving body and which is located with its axis of rotation in the belt tongue entry path, the revolving body having a recess in alignment with the insertion paht and the locking member having a control arm operable by the ejector for the purpose of locking and which ensures that the locking membler has locked and unlocked position.

12 Claims, 5 Drawing Sheets

FIG. 4
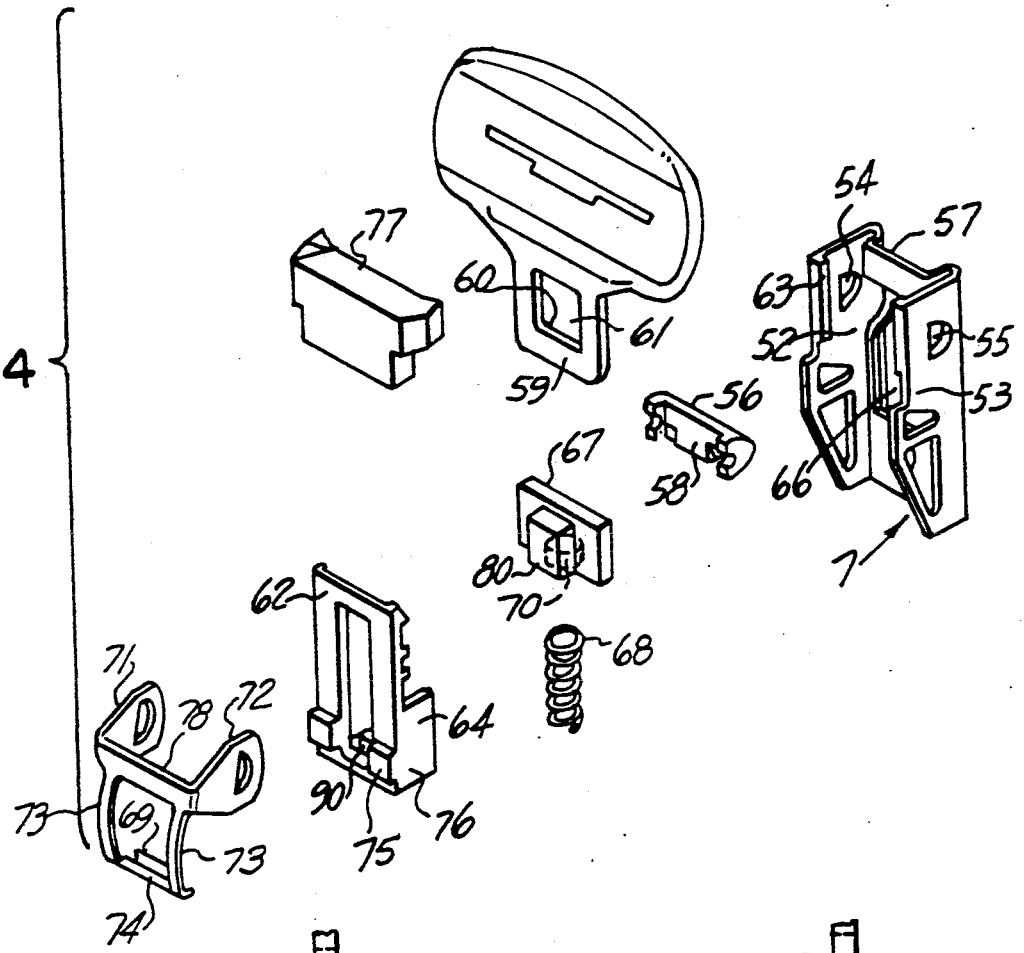
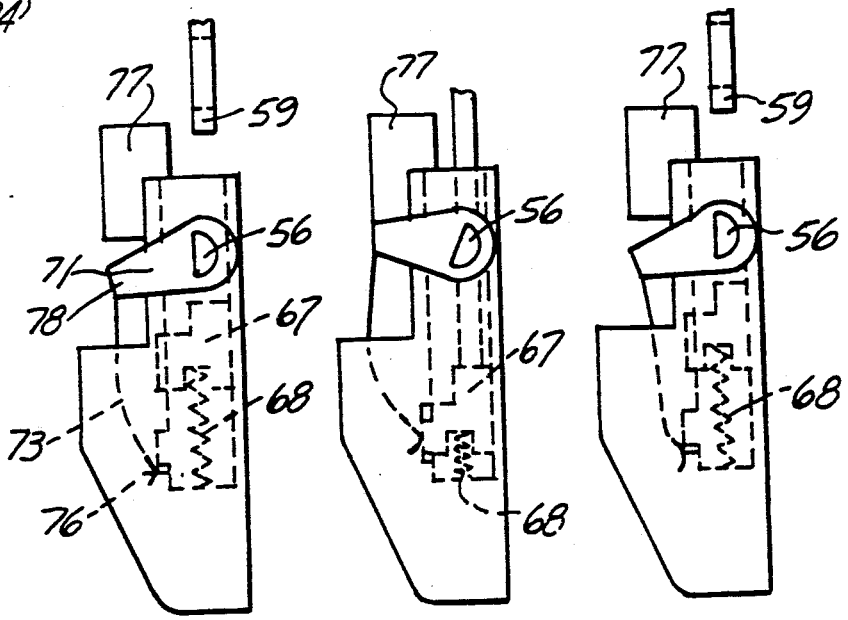
FIG. 5a FIG. 5b FIG. 5c

BUCKLE FOR A SAFETY BELT

The invention relates to a buckle for a safety belt, especially but not exclusively of a motor vehicle.

Such a buckle known from German Patent Specification 33 44 041 involves a direct transfer of force from a belt tongue via a locking member to a frame. The locking member can be made from a single light-weight stamped component. The axis of tilt about which the locking member is moved from the opened position into the closing position and vice-versa, is located at a substantial distance from the point at which the locking member engages an aperture of the tongue. To achieve direct transfer of force from the tongue via the locking member to the frame, it is essential for supporting surfaces to lie accurately side by side and additional components are used which must be manufactured with high precision. Otherwise, at lease a component of the force will also be transferred to the casing via the pivot axis.

The purpose of the invention is accordingly to create a buckle of the above general type by which a direct transfer of force is achieved between the belt tongue and the locking member into the frame without the aid of additional components.

According to the present invention there is provided a buckle for a safety belt comprising a main frame within which an entry path for a belt tongue is defined, a resiliently biassed ejector movable in said path in a direction to oppose entry of said tongue, a locking member movable about an axis to carry a locking part into or out of the entry path for lockingly engaging said tongue and characterised in that said locking member comprises a body angularly moveable about an axis lying within the entry path of the tongue said member being shaped to allow the tongue to pass through it.

In order that the invention may be more clearly understood and readily carried into effect, the same will be further described by way of examples with reference to the accompanying drawings of which:

FIG. 1 illustrates individual components of a buckle in accordance with one embodiment.

FIGS. 2*a*–2*g* illustrate successive stages of the operation of an assembled buckle of FIG. 1.

FIG. 4 illustrates individual components of a buckle in accordance, with an alternative embodiment and FIGS. 5(*a*)–5(*c*) illustrate successive stages of the operation of an assembled buckle of FIG. 4.

Figure 1:
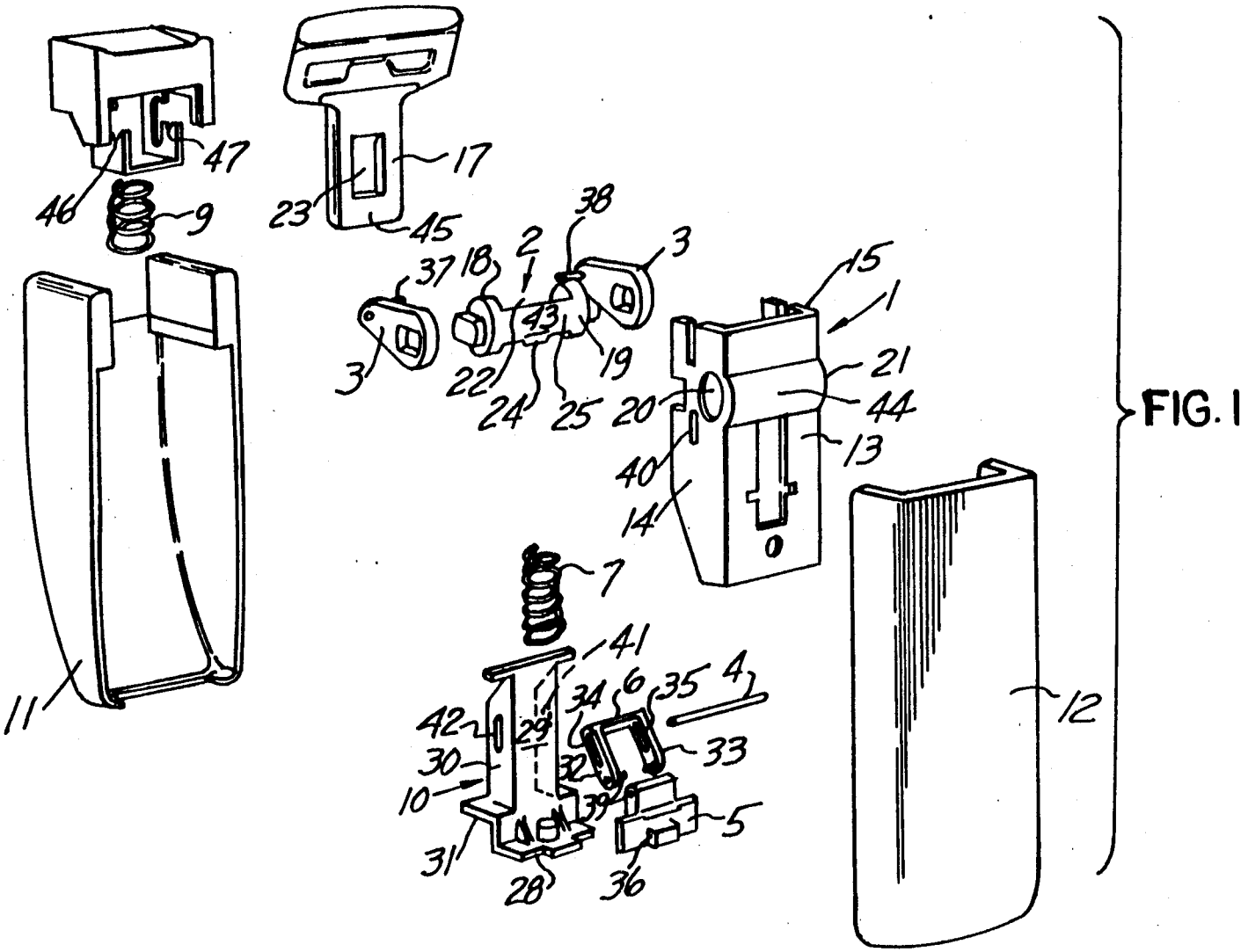

Referring now to FIGS. 1 and 2, the buckle has a frame 1 of generally a U-shaped cross-section base plate 13 with side flanges 14, 15 which define the sides of an entry path 16 for a belt tongue 17 through which a loop of a safety belt (not shown) is drawn. A cylindrical locking member or bolt 2 which is fully cylindrical at its ends 18, 19 is accommodated in circular bearing apertures 20, 21 of the two flanges 14, 15 of the frame 1. The middle part of the locking member 2 has a recess 22 which leaves entry path 16 clear when the tongue 17 is inserted. At both ends of the locking member 2 are situated two control levers 3 fitted to rotate with 2. The axis of swivel of these two control levers 3 coincides with the axis of rotation A of the locking member 2. This axis of rotation A of the locking member 2 is located,. as can be seen particularly from FIG. 2, in the entry path 16 in the area of a retaining aperture 23 of the tongue 17 in which, when in the locked position, the locking bolt 2 engages with a locking part in the form of a nose 24 formed on 2.

Figure 3:
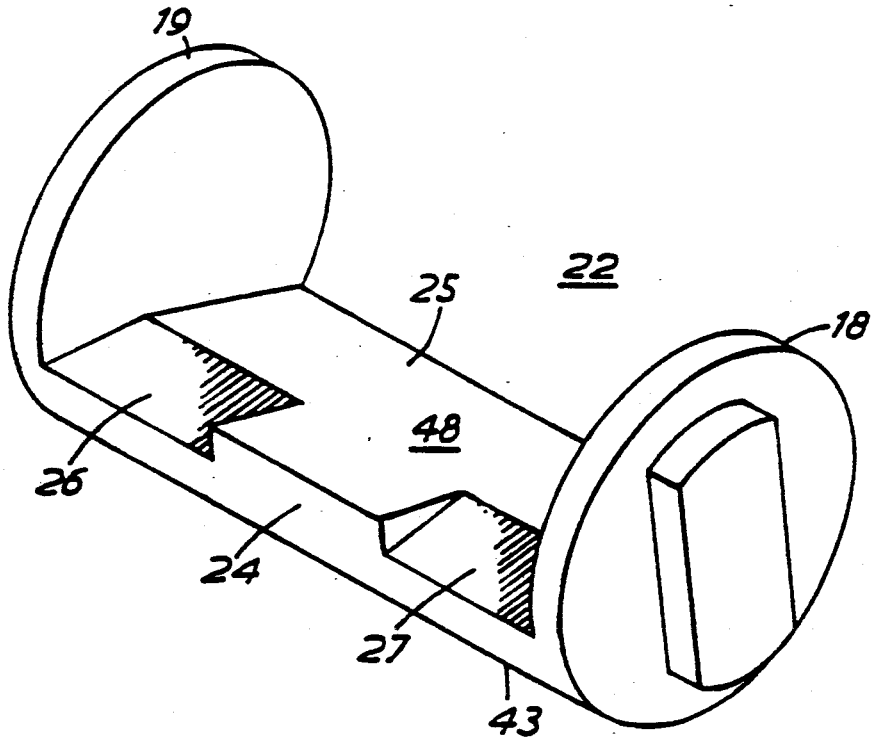
FIG. 3 illustrates on an enlarged scale the locking member of the buckle of FIG. 1.

As shown in FIG. 3, the locking member 2 is formed with a cylinder segment 25 the width of which accepts the tongue 17. A nose 24 is acceptable in the retaining aperture 23 of the tongue 17 when the locking member is rotated about axis A. The nose 24 is formed by virtue of two sector-shaped recesses 26, 27 the width of which accepts the parts of the tongue on each side of the aperture 23. The base plate 13 of the frame 1 has a part-cylindrical depression contour 44 in which the surface 43 of the cylindrical segment 25 of the locking member 2 fits.

The frame 1 contains a slideable tongue ejector 5 urged by a ejection spring 7 in the direction of ejection of the tongue. The ejection spring 7 rests on a spring support 28 of the spring carrier 10 located in the main frame. 1. Spring carrier 10 has a guide surface 29 for movement of the ejector 5. On the other side of a central crosspiece 30 on the spring carrier 10 and forming part of this guide surface 29 is located a support device 31 for another push-button spring 9 designed as a pressure spring which acts upon a push-button 8. This push-button 8 serves, as is illustrated in detail, to release the process of unlocking for the tongue 17 out of the locked position.

Pivotally linked at 39 to ejector 5 is an ejection control arm 6. Control arm 6 is generally U-shaped with two side arms 32, 33, spanning the part 30 of the spring carrier 10. Both arms 32, 33 of the control arm 6 have slots 34, 35 engaging a control pin 4. The pin 4 extends through a slot 42 in the part 30 and further slots 40, 41 guide the control pin 4 in the flanges 14, 15 of the frame 1. The outer ends of control levers 3 have drive pins 37, 38 which also engage the slots 34, 35 of the arms 32, 33 of the ejection arm 6.

The buckle just described, is provided with a top cover 11 and a bottom cover 12 which are suitably clipped in position.

Figure 2A:
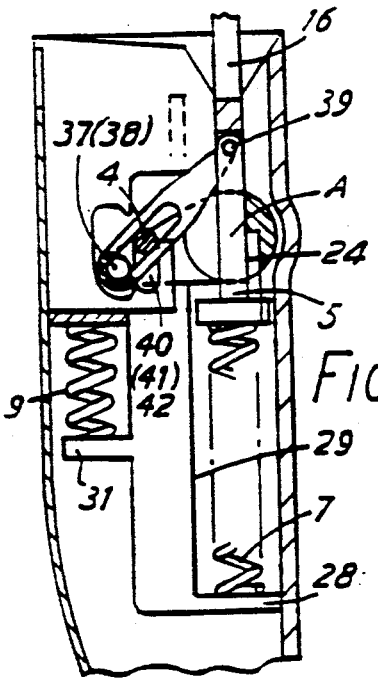

In operation of the buckle the ejector 5 in FIG. 2*a* is kept in this position by the force of the ejector spring 7. The pivots 39 of the ejector control arm 6 are also to be seen in the extreme top position. The control pin 4 is likewise situated at the upper ends of the slots 40, 41 which in the lateral flanges 14, 15 extend in the direction of insertion or ejection. The control levers 3 can be seen with their tilting ends in the lower positions in FIG. 2*a*, in which the nose 24 of the locking member 2 rests out of the insertion path 16. In this position the force of the spring 9 exerts an initial upwards force on the tilting end of control lever 3. The nose 24 of the locking member 2 is thereby prevented from being swivelled into the insertion path 16. The nose 24 moreover rests at surface 36 of the ejector 5 and is thus kept out of the insertion path 16.

Figure 2B:
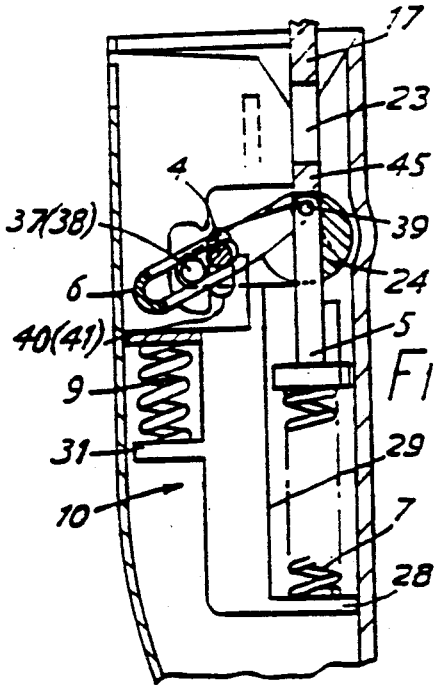

When the tongue 17 is inserted from above as indicated in FIG. 2*b*, downwards into the insertion path 16, the ejector 5 is moved downwards against the force, of the ejection spring 7. At the same time the pivots 39 of the ejection arm 6 moves downwards, whereby the control pin 4 moves both along the slots 34, 35 in the arm 6 and in the fixed slots 40, 41 in the frame. As long as the nose 24 of the locking member is supported on the contact surface 36 of the ejector 5 and subsequently, when the tongue 17 is inserted further, rests on the bottom surface of the front cross-piece 45 of the tongue 17 (FIGS. 2*a*–*c*), the locking member 2 remains in the open position shown. At the same time a torque is applied by the push-button spring 9 via levers 3 in the locking direction of member 2.

Figure 2C:
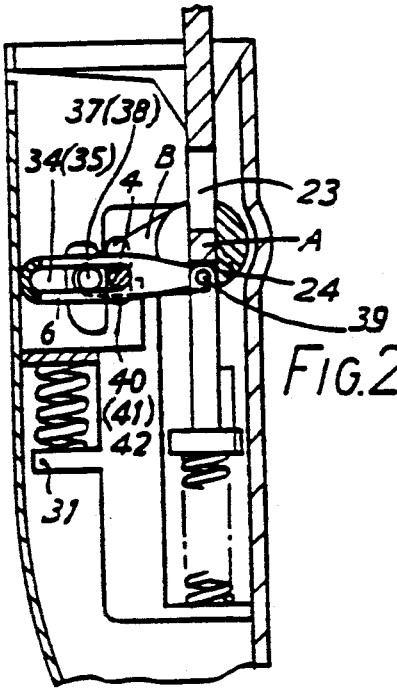

In FIG. 2c is shown a transition point at which the drive pins 37, 38, the control pin 4 and the position of pivots 39 for the ejection control arm 6 on the ejector 4 are situated at right angles with respect to the frame 1.

Figure 2D:
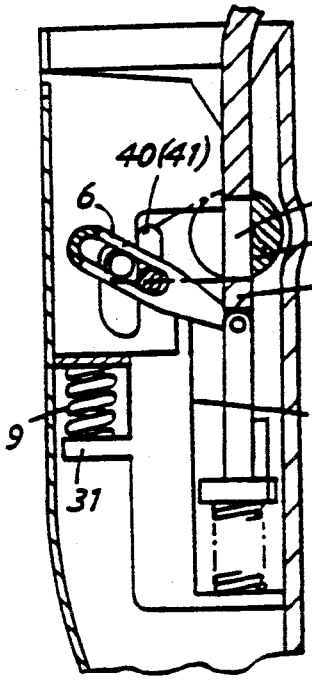
Figure 2E:
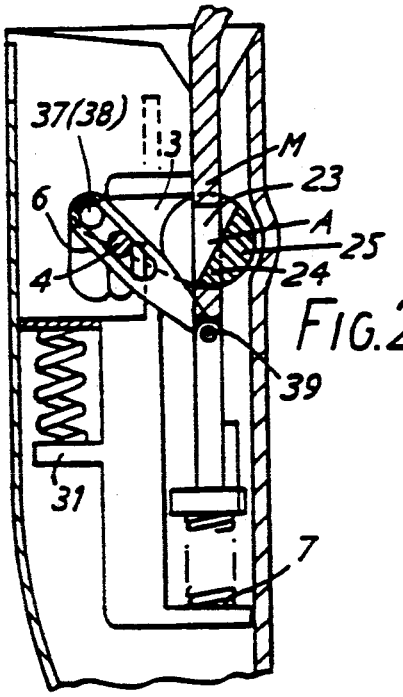
Figure 2F:
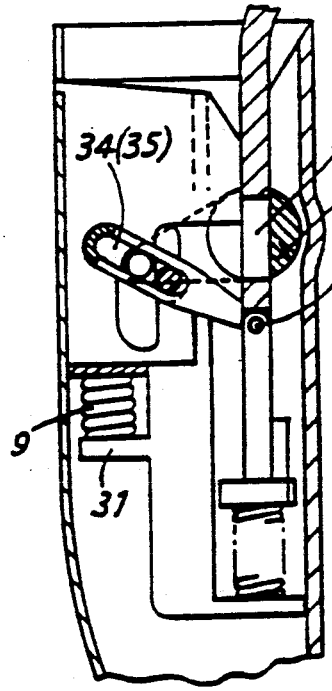
Figure 2G:
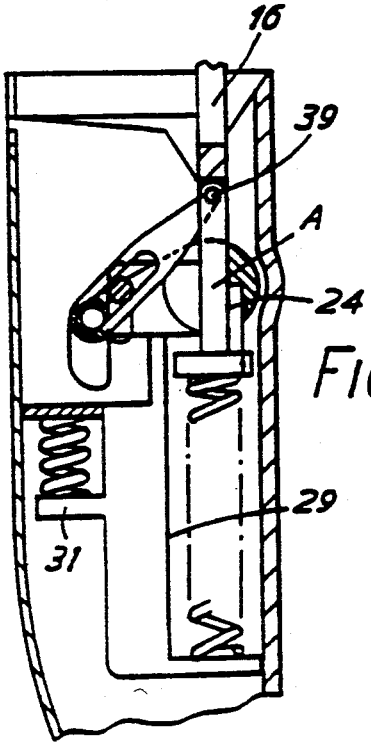

If the front cross-piece 45 of the tongue 17 has moved past the nose 24 of the member 2 as in FIG. 2d and at this moment the position of linkage 39 of the control arm 6 has attained a lowermost position, the control pin 4 in the fixed slot 42 of the spring carrier 10 and slots 40, 41 occupies the position at the lower end, and the ends of the control levers 3 are swivelled upwards due to the force of the push-button spring 9, whereby the nose 24 of the locking member 2 is swivelled into the aperture 23 of the tongue 17 and occupies the locked position of FIG. 2e. The pin 4 is then located at the top end of the fixed slot 42 and slots 40, 41 and the ends of levers 3 located with the drive pins 37, 38 rotate the locking member 2 to the locking position shown in FIG. 2e. This results in a positive locking, of the tongue 17 in the frame.

In the foregoing operation, the spring 9 acts continuously upon the push-button 8. In its parallel side walls the push-button 8 has grooves 46, 47 into which the control pin 4 fits. With the push-button 8 urged upwards under the action of the push-button spring 9 in the transition from the position in FIG. 2d to 2e, the control pin 4 is also displaced upwards. As control pin engages in the slots 34, 35 of the ejection control arm 6, the latter is likewise tilted from the position in FIG. 2d into the uppermost position in FIG. 2e. Since drive pins 37, 38 at the ends of the control levers 3 engage in the slots 34, 35 of the ejection control lever 6, the ends of the control levers 3 are also brought into the top position (FIG. 2e), whereby the nose 24 moves into the retaining aperture 23 of the tongue 17.

From the scaled-up perspective representation in FIG. 3 of the locking member it will be clear that contact area 48 of the cylinder segment 25 is flat and as will be seen from FIGS. 2a–2d, 2f and 2g, forms a portion of the right-hand area of the insertion path 16. The nose 24 is moved into the insertion path around axis A as shown in FIG. 2e to project into the retaining aperture 23 of the tongue 17.

In order to release the tongue 17 from the locked position of FIG. 2e, the push-button 8 is actuated against the force of the push-button spring 9. The locking control levers 3, carrying pins 37, 38 are driven tilted downwards in an anti-clockwise direction as in FIG. 2f. At the same time the nose 24 of the locking member 2 becomes disengaged from the aperture 23 of the tongue 17, the force of the ejector spring 7 then moves the ejector 5 upwards. The ejector thus ejects 17 and moves as far as its stop as in FIG. 2g.

When the push-button 8 is released, it returns under the action of the push-button spring 9 back into the starting position. The buckle then has again reached the opened position shown in FIG. 2a and is prepared for a new operation.

In the alternative embodiment of the invention as illustrated in FIG. 4, the safety buckle comprises a main frame 1 having side flanges 52 and 53, part-circular apertures 54 and 55 thereof receiving a part-cylindrical locking member 56. The central base portion 57 of the frame is set inwards as shown and provided with a part-cylindrical depression with an inner surface contiguous with the part circular inner surfaces of the apertures 54 and 55. The member 56 has a locking part 58 which when the member 56 is rotated to bring it into the path of an inserted safety belt tongue such as 59 to abut with front inner surface 60 of an aperture 61. Facing the central base portion 57 of the frame a spring-retaining and stop member 62 is located in the frame member by internal rails 63 and by a projection 64 which locates in an aperture 66 of the frame. Thus the inner surfaces of 62 and 57 define the entry path for the belt tongue 59 and accommodates a slideable ejector element 67 having a spring 68 located by a peg of member 62 and a blind aperture 70 of ejector 67.

The locking member 56 is rotatable through an angle, sufficient to bring the locking part 58 into the entry path of the belt tongue, by levers 71 and 72 formed integrally of spring steel with a latching spring 73 carrying a latch bar 74. The levers 71 and 72 carry D-shaped apertures which enable them to be sprung over and key onto the outer ends of the member 56 outside the side flanges 52 and 53. When locking member 58 is in its locking position latch bar 74 rests on a surface 75 of the member 62 but can be slidingly moved against the resilience of the spring 73 into a position where it drops over and is held by a step 76. Such movement into this its latched position results in the member 58 being rotated out of the path of tongue 59 and is effected by depressing a control member in the form of a release button 77. The button 77 is formed with a moulded plastic and spring tongue (not shown) which enables it to guidingly slide in the frame, thereby engaging directly on the part 78 joining levers 71 and 72. The latch bar 74 is further provided with an angled guide stop which is engageable by the forward edge 80 of the ejector 70 when actuated by insertion of the tongue 59 to thereby release the latch bar 74 from the step 76 and allow the lock member to rotate into its locking position.

The operation of the buckle of FIG. 4 is illustrated in FIGS. 5(a), 5(b) and 5(c). In the free condition of FIG. 5(a) it is seen that control button 77 is undepressed and spaced from part 78 which is retained in the position shown by the spring 73 being latched at step 76. The tongue ejector 67 is in the unactuated state under the influence of its spring 68 and locking member 56 is held in the open or unlocked condition by lever 71 connected to latch spring 73. When the tongue 59 is inserted and pushed home against the ejector 67 and its spring 68 as shown in FIG. 5(b) the surface 80 rides under the latch bar 74 and the resilience of spring 73 is such as to allow it to move to its less stressed and more curved shape exerting a turning movement on levers 71. This turning movement rotates the locking member in a sense which now brings the locking part 58 into the entry path and into the now aligned aperture 61 of the belt tongue 59. The tongue is thereby locked against withdrawal as the action on part 58 of surface 60 of the tongue is such as to exert no unlocking rotational force on member 56.

In the locked condition of FIG. 5(b) the part 78 now rests close to but not in contact with button 77 and when it is required to release the tongue an easily applied manual force in the direction of the arrows as shown in FIG. 5(c) can return the part 78 and levers 71 to their initial latched position whereat 56 is rotated to its unlocked state and the tongue 59 is ejected by the force of compressed spring 68.

In the embodiments of the invention described in the foregoing, the centre of rotation A of the generally cylindrical locking member 48 or 56 lies substantially midway between the faces of the tongue entry path and the tongue 45 or 59 when inserted. However if the centre of rotation is arranged to lie slightly away from such middle position in the direction of entry of the locking part 24 or 58 the reaction force can be arranged to create a force couple which urges the locking member into the locking position. Such needs to be considered however in relation to the increased manual release force which is necessary to be applied to the release button 8 or 77. Even without such off-centre rotation it will be seen that the off-centre centre of mass of the locking member 48 or 56 in the normal operating mode us such as to tend to urge the locking member towards the locking position.

We claim:

1. A buckle for a safety belt comprising a main frame within which an entry path for a belt tongue is defined, a resiliently biassed ejector moveable in said path in a direction to oppose entry of said tongue, a locking member moveable about an axis (A) a locking part carried by the locking member into or out of the entry path for lockingly engaging said tongue, wherein said locking member comprises a body angularly moveable about the axis lying within the entry path of the tongue, said locking member being shaped to allow the tongue to enter therein, wherein the locking member is a generally cylindrical body which is cut away to provide a segment on one side of the entry path of the tongue said segment defining a nose or projection which moves about the axis (A) into a retaining aperture of the tongue.

2. A buckle in accordance with claim 1 wherein the locking member rotatably slides relative to a part-cylindrical depression formed in the frame.

3. A buckle in accordance with claim 2, wherein when the locking member is in a position with the locking part out of the entry path, the locking part is biassed towards a locking position in said path.

4. A buckle in accordance with claim 3, wherein the locking member is acted upon by a biasing torque towards the locking position.

5. A buckle in accordance with claim 4, wherein the position of the locking part is governed by a locking control lever rotatably fixed thereto.

6. A buckle in accordance with claim 5, wherein said lever is one of two levers fixed to respective ends of the locking member.

7. A buckle in accordance with claim 6, wherein the torque acting on the locking member is provided by a spring of a push button operable to release the belt tongue.

8. A buckle in accordance with claim 8, wherein an ejection control arm is moveably linked to the ejector and has at least a slot through which a control pin projects, said pin being slideable in a slot in each of two side plates of the frame which extend in a direction of insertion or ejection, and the locked position and the unlocked position are determined by respective end positions of the control pin in the slots.

9. A buckle in accordance with claim 8, wherein the lever is moved between the unlocked and the locked position by means of the ejector.

10. A buckle as claimed in claim 2, wherein the locking member is rotatable by a control lever received thereabout and latch means operable by a buckle release member to retain said locking member in a release position and a spring biassed tongue ejector is operable to release said latch means upon insertion of the tongue to a predetermined position in the entry path.

11. A buckle as claimed in claim 10, wherein the control lever is formed integrally with a spring, the stressing of which increases toward a latching position.

12. A buckle as claimed in claim 11, wherein the spring is formed integrally with a part which is resiliently urged thereby against a surface having a step; which cooperates with said part to provide the latching.

* * * * *